United States Patent [19]

Kadotani et al.

[11] Patent Number: 5,074,116

[45] Date of Patent: Dec. 24, 1991

[54] PARTITION TYPE RADIATION LOCAL AIR CONDITIONING UNIT

[75] Inventors: Kanichi Kadotani, Atsugi; Tetsuo Onishi, Yokohama; Takashi Ishihara, Hiratsuka, all of Japan

[73] Assignee: Kabushiki Kaisha Komatsu Seisakusho, Japan

[21] Appl. No.: 460,078

[22] PCT Filed: Jun. 29, 1989

[86] PCT No.: PCT/JP89/00649

§ 371 Date: Feb. 5, 1990

§ 102(e) Date: Feb. 5, 1990

[87] PCT Pub. No.: WO90/00240

PCT Pub. Date: Jan. 11, 1990

[30] Foreign Application Priority Data

Jun. 30, 1988 [JP] Japan ..... 63-163711

[51] Int. Cl.[5] ..... F25B 21/02

[52] U.S. Cl. ..... 62/3.2; 454/236

[58] Field of Search ..... 62/3.2, 3.1, 3.3.3.4; 98/31.6, 34.6; 165/49

[56] References Cited

U.S. PATENT DOCUMENTS

| | | | |
|---|---|---|---|
| 2,162,523 | 6/1939 | Blood et al. | 98/31.6 |
| 4,463,569 | 8/1984 | McLarty | 62/3.2 |
| 4,505,118 | 3/1985 | Altman | 62/3.2 |
| 4,694,736 | 9/1987 | Yamagata et al. | 98/31.6 |
| 4,727,385 | 2/1988 | Nishikawa et al. | 355/30 |
| 4,784,445 | 11/1988 | Ott | 98/31.6 |

FOREIGN PATENT DOCUMENTS

| | | |
|---|---|---|
| 263330 | 10/1988 | Japan . |
| 1-6631 | 1/1989 | Japan . |

*Primary Examiner*—Albert J. Makay
*Assistant Examiner*—William C. Doerrler
*Attorney, Agent, or Firm*—Richards, Medlock & Andrews

[57] ABSTRACT

A partition type radiation local air conditioning unit is used in the field of air conditioning equipment and of office furniture. The unit is intended to make it possible to provide a better feeling of coolness by combining radiation cooling with convection cooling and to diminish the size of the air conditioning unit, which is in the form of a partition unit (1). This partition unit (1) includes a crossflow fan (4*h*) for blowing out breeze, an air inlet (4*ha*), and a breeze outlet (4*hb*), which are so arranged that the breeze (41) from the breeze outlet (4*hb*) is blown against the face of a person sitting in front of the unit. A baffle plate (9) can be provided in the air passage (7) between the crossflow fan (3) for heat-dissipating-air blowing and the radiation fins (2*b*) of thermoelectric elements (2*a*), the baffle plate (9) dividing this air passage (7) into a heat-dissipating-air passage (71) and a breeze air passage (72). Further, a breeze outlet (4*b*2) communicating with the breeze passage (72) can be provided immediately below the cooling plate (2). This arrangement helps to make a person sitting in front of the partition unit get a better feeling of coolness than from conventional air conditioning units of this type and to diminish the size of the partition unit (1).

10 Claims, 6 Drawing Sheets

FIG. 1b
(PRIOR ART)
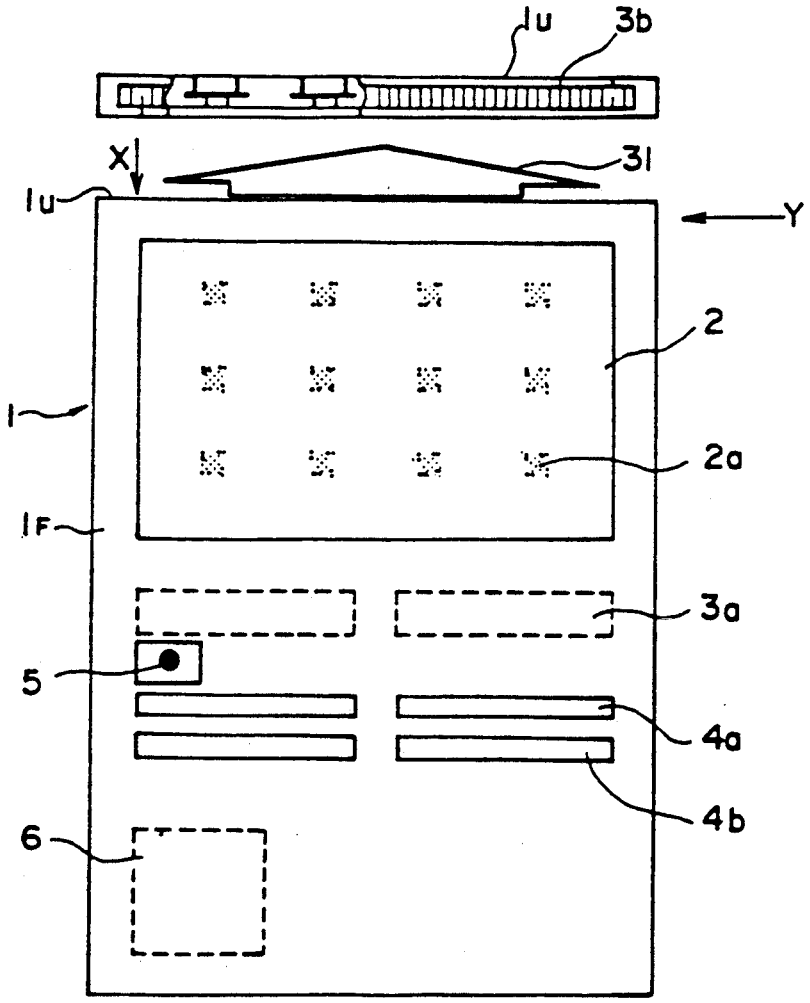
FIG. 1a
(PRIOR ART)
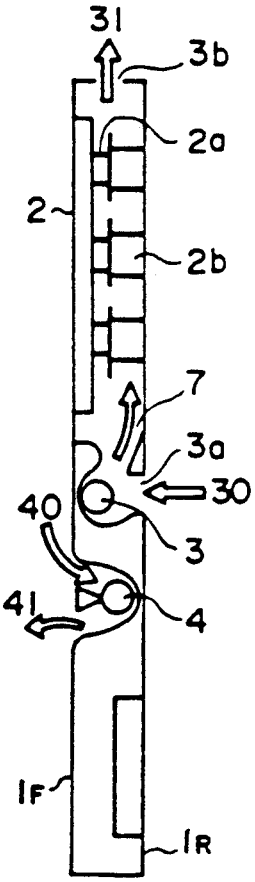
FIG. 1c
(PRIOR ART)

FIG. 2b
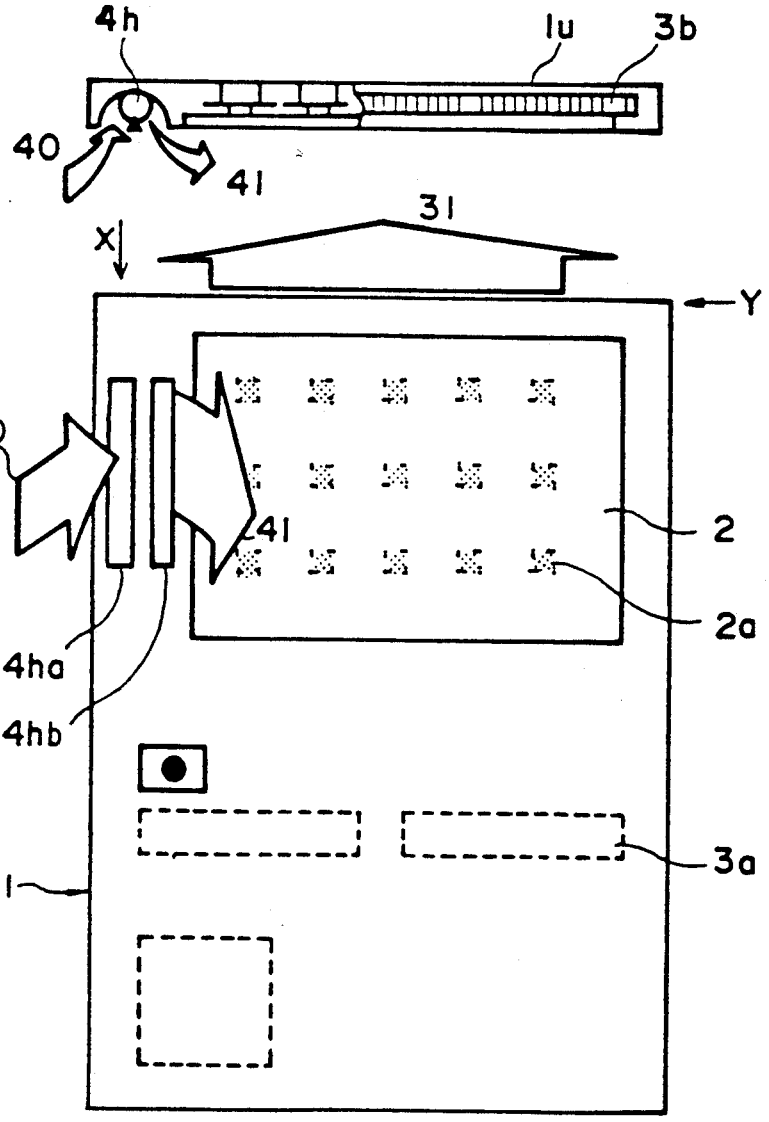
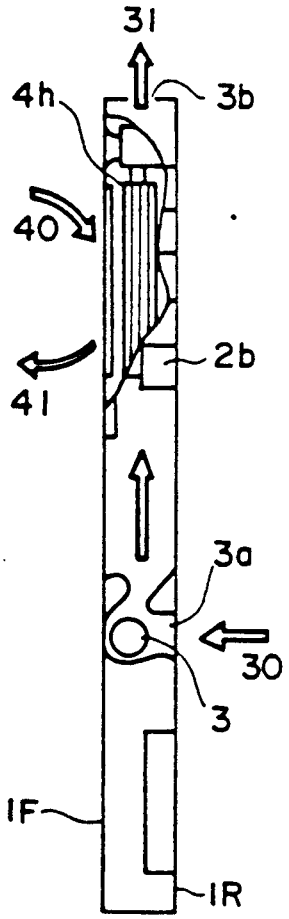
FIG. 2a
FIG. 2c

FIG. 5b
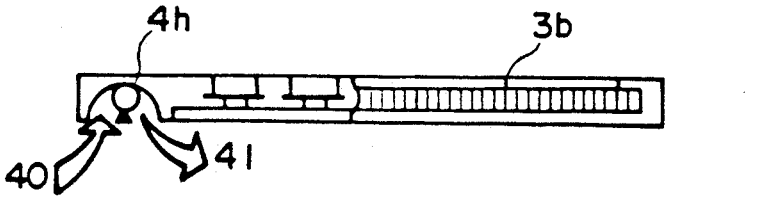
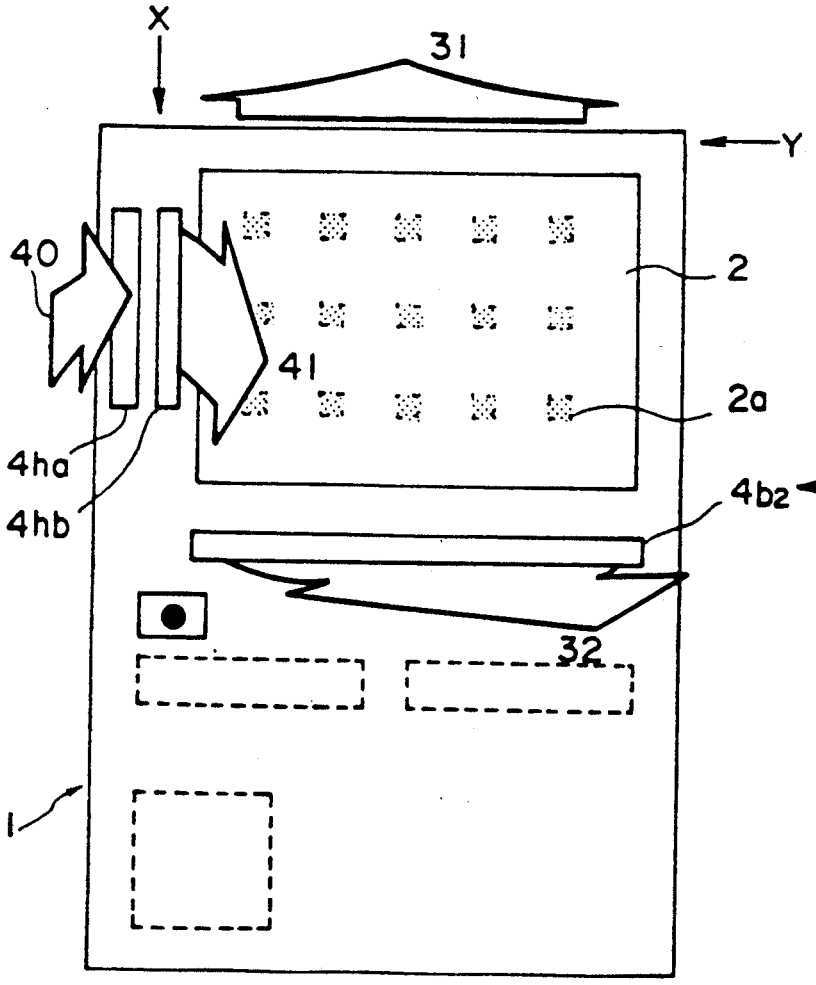
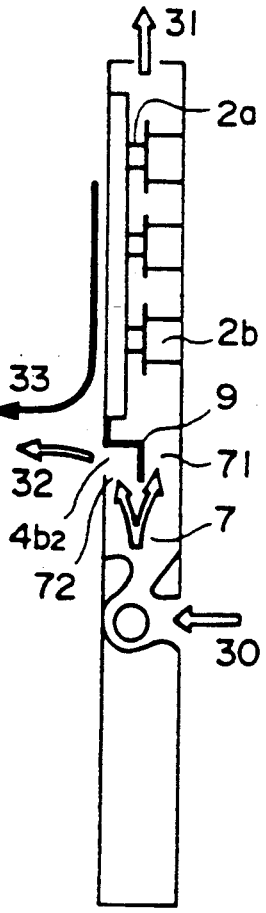
FIG. 5a
FIG. 5c

PARTITION TYPE RADIATION LOCAL AIR CONDITIONING UNIT

FIELD OF THE INVENTION

This invention relates to a radiation type local air conditioning unit used in the field of air conditioning equipment and of office furniture.

BACKGROUND OF THE INVENTION

Recently, office automation equipment (hereinafter referred to as "OA equipment") has come into common use in most offices. As the number of OA equipment units increases, maldistribution of heat load due to the heat generated by them becomes conspicuous, resulting in some parts of the room being rather warm and the other parts thereof too cold. This maldistribution is hard to eliminate by overall air conditioning, and requires complicated and expensive air conditioning equipment.

The radiation type air conditioners utilizing thermoelectric elements, proposed by Kanichi Kadotani and Tetsuo Onishi (see Japanese Patent Applications No. 62-97606 and 62-160939), are examples of apparatus for locally adjusting room temperature conditions.

FIGS. 1*a*, 1*b* and 1*c* illustrate a partition unit constituting a radiating air conditioner of this type; the partition unit is shown here in a front view, a partially sectional view taken in the direction of the arrow X, and a sectional view taken in the direction of the arrow Y. This partition unit is covered on all sides with panels. The front panel IF has, in the upper section thereof, a cooling plate 2 which is equipped, on its rear side, with a plurality of thermoelectric elements 2*a* and associated radiation fins 2*b*. Provided in the middle section of the front panel IF are air inlets 4*a*, breeze outlets 4*b*, and a power switch 5. Heat-dissipating-air inlets 3*a* and a heat-dissipating-air outlet 3*b* are provided in the middle section of the rear panel 1R and in the upper panel 1U, respectively. Provided in the middle section of the inner space of the partition unit 1 are a crossflow fan 3 for heat-dissipating-air blowing and a crossflow fan 4 for blowing out breeze, which are set in the horizontal position and are spaced apart from each other with respect to a vertical line. A power source controller 6 is provided below these crossflow fans.

When, in this construction, the power source controller 6 is operated by turning on the power switch 5 and electricity is supplied to the thermoelectric elements 2*a* so as to cause the cooling plate 2 to absorb heat by the Peltier effect, radiation cooling is effected on the front side (the side of the front panel IF) of the partition unit 1. The air 30, which is sucked in through the heat-dissipating-air inlets 3*a* by the crossflow fan 3 for heat-dissipating-air blowing, flows through an air passage 7 and comes into contact generated by the thermoelectric elements 2*a*. The air 30 is then discharged, as exhaust 31, to the exterior through the radiation outlet 3*b* in the upper panel 1U.

On the other hand, the air 40, which is sucked in through the air inlets 4*a* in the front panel IF by the crossflow fan 4 for blowing out breeze, is blown out, as air 41, through the breeze outlets 4*b*, thereby effecting convection cooling on the front side (the side of the front panel 1F) of the partition unit 1.

Thus, the radiation cooling by the cooling plate 2 is combined with the convection cooling by the crossflow fan 4 for blowing out breeze, thereby locally providing comfortable coolness.

However, the above described partition type radiation local air conditioning unit has the following problems:

1. Problem regarding coolness

The positions of the breeze outlets in the front panel of the partition unit are not ideal ones from the viewpoint of the synergetic cooling effect to be obtained by radiation cooling and convection cooling, which prevents satisfactory coolness from being obtained.

2. Problem regarding the apparatus size

The crossflow fan for blowing out breeze, set in the horizontal position, occupies a large space in the partition unit, which makes it difficult for the unit size to be diminished This constitutes a problem since partition type radiation local air conditioning units are required to be lighter, smaller and simpler.

SUMMARY OF THE INVENTION

It is accordingly an object of this invention to provide a partition type radiation local air conditioning unit which makes it possible to provide a better feeling of coolness by radiation cooling and to diminish the partition size.

In accordance with this invention, there is provided a partition type radiation local air conditioning unit comprising: a partition unit; a cooling plate provided in the partition unit; a plurality of thermoelectric elements provided in the cooling plate and adapted to produce the Peltier effect, radiation air cooling being effected by cooling the cooling plate by the Peltier effect obtained by the thermoelectric elements; and a breeze generating means provided in the partition unit and including a crossflow fan for blowing out breeze, an air inlet, and a breeze outlet; the breeze generating means being so arranged that the breeze from the breeze outlet is substantially blown against the face of a person sitting in front of the partition unit. Thus, in addition to the radiation cooling by the cooling plate, the breeze from the breeze outlet works effectively, thereby making the person feel a more comfortable coolness.

In another aspect of this invention, there is provided a partition type radiation local air conditioning unit comprising: a partition unit; a cooling plate provided in the partition unit; a plurality of thermoelectric elements provided in the cooling plate and adapted to produce the Peltier effect; a plurality of radiation fins associated with thermoelectric elements; a crossflow fan for heat-dissipating-air blowing provided in the partition unit and adapted to suck in air from the exterior, the air thus sucked in absorbing heat from the radiation fins and being blown out to the exterior as heat-dissipating-air; an air passage provided between the crossflow fan for heat-dissipating-air blowing and the radiation fins; a baffle plate provided in the air passage and dividing it into a heat-dissipating-air passage and a breeze passage; and a breeze outlet provided immediately under the cooling plate and communicating with the breeze passage. The air flowing through the heat-dissipating-air passage absorbs heat from the radiation fins and is blown out to the exterior as heat-dissipating-air. The air flowing through the breeze passage is blown out as breeze. This breeze forms a convection cold air flow together with the cold air descending along the cooling plate, thereby making the person before the unit feel cooler. Furthermore, since no special crossflow fan is used to generate breeze, the partition unit can be made smaller accordingly.

BRIEF DESCRIPTION OF THE DRAWINGS

FIGS 1*a*, 1*b* and 1*c* illustrate a partition unit which constitutes a conventional partition type radiation local air conditioning unit, with FIG. 1*a* being a front view, FIG. 1*b* being a partial sectional view taken in the direction of the arrow X in FIG. 1*a*, and FIG. 1*c* being a sectional view taken in the direction of the arrow Y in FIG. 1*a*;

FIGS. 2*a*, 2*b* and 2*c* illustrate a partition unit in accordance with a first embodiment of this invention, with FIG. 2*a* being a front view, FIG. 2*b* being a partial sectional view taken in the direction of the arrow X in FIG. 2*a*, and FIG. 2*c* being a sectional view taken in the direction of the arrow Y in FIG. 2*a*;

FIGS. 5*a*, 5*b* and 5*c* illustrate a partition unit in accordance with a fourth embodiment of this invention, which is a combination of the first and second embodiments, with FIG. 5*a* being a front view, FIG. 5*b* being a partial sectional view taken in the direction of the arrow X in FIG. 5*a*, and FIG. 5*c* being a sectional view taken in the direction of the arrow Y in FIG. 5*a*.

DETAILED DESCRIPTION

Figure 3A:
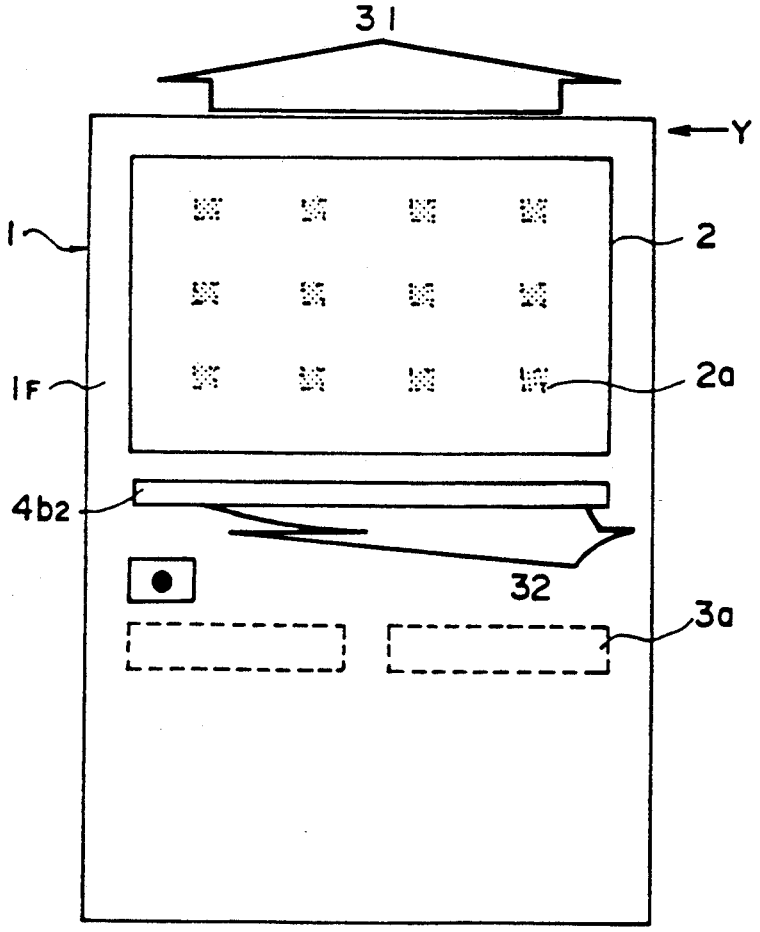
FIGS. 3*a* and 3*b* illustrate a partition unit in accordance with a second embodiment of this invention, with FIG. 3*a* being a front view, and FIG. 3*b* being a partial sectional view taken in the direction of the arrow Y in FIG. 3*a*.

Embodiments of this invention will now be described with reference to the accompanying drawings.

FIGS. 2*a*, 2*b* and 2*c* show a partition unit in accordance with the first embodiment of this invention. Unlike the above described conventional air conditioning unit, this embodiment does not employ a crossflow fan 4 for blowing out breeze, air inlets 4*a*, or breeze outlets 4*b*; in the conventional unit, these components are set in the horizontal position and are arranged below the cooling plate 2. Instead, this embodiment adopts a vertical crossflow fan 4*h*, an air inlet 4*ha* extending in the vertical direction, and a breeze outlet 4*hb* whose duct angle can be adjusted. These components are arranged in the partition unit, at positions on the left-hand (or right-hand) side (as seen in the drawing) of the cooling plate 2. When the crossflow fan 4*h* is driven, the air 40, sucked in through the air inlet 4*ha*, is blown out through the breeze outlet 4*hb*, and flows obliquely over the front surface of the cooling plate 2, and is blown, as breeze 41, against the face of a person in front of the partition unit. The air velocity around the human face can be adjusted within the range of about 0 to 2.0 m/s. The synergetic effect of this breeze 41 and the radiation cooling by the cooling plate 2 provides a feeling of coolness more effectively.

Figure 3B:
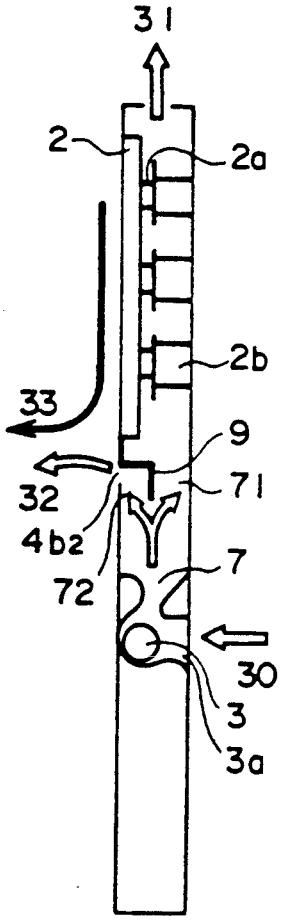

FIGS. 3*a* and 3*b* show a partition unit in accordance with the second embodiment of this invention. Unlike the above-described conventional air conditioning unit, this embodiment does not employ a crossflow fan 4 for blowing out breeze, air inlets 4*a*, or the breeze outlets 4*b*; in the conventional unit, these components are set in the horizontal position and are arranged below the cooling plate 2. Instead, this embodiment adopts a baffle plate 9 which is provided in the air passage 7 between the crossflow fan 3 for heat-dissipating-air blowing and the radiation fins 2*b* of thermoelectric elements 2*a*, dividing this air passage 7 into a heat-dissipating-air passage 71 and a breeze air passage 72. At the same time, a breeze outlet 4*b*2 communicating with the breeze air passage 72 is arranged immediately below the cooling plate 2. When the crossflow fan 3 for heat-dissipating-air blowing is driven, that portion of the air 30 passing through the heat-dissipating-air passage 71 absorbs heat from the radiation fins 2*b*, and is blown out as heat-dissipating-air 31. On the other hand, that portion of the air 30 passing through the breeze air passage 72 flows horizontally under the cooling plate 2 and is blown out through the breeze outlet 4*b*2 in such a manner as to be blown, as breeze 32, against the upper part of the body of a person in front of the partition unit (in particular, the shoulders, the face and the head) at a velocity ranging from approximately 0.2 to 0.4 m/s. This breeze 32 forms, together with the cold air descending along the cooling plate 2, a convection cold air flow which works effectively, so that, in addition to the radiation cooling by the cooling plate 2, more coolness can be obtained. Moreover, since no special cross-flow fan 4 or the like has to be provided to obtain breeze, the size of the partition unit 1 can be diminished accordingly.

Figure 4:
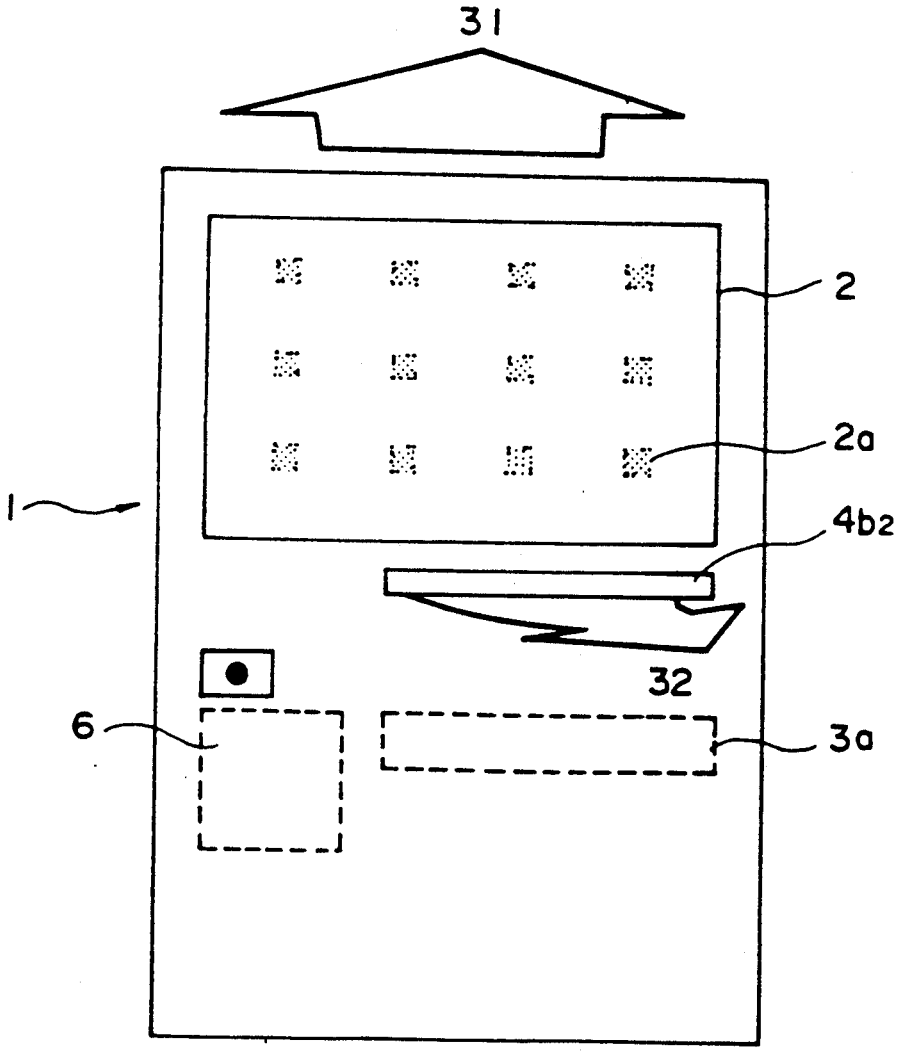
FIG. 4 is a front view illustrating a partition unit in accordance with a third embodiment of this invention.

FIG. 4 is a front view of a partition unit in accordance with the third embodiment of this invention. A power-source controller 6 is incorporated into the partition unit 1. At the same time, a breeze outlet 4*b*2 whose length is smaller than the width of the cooling plate 2 is arranged immediately below this cooling plate. The length of this outlet can be diminished to half the width of the cooling plate 2, yet it provides substantially the same effect as that of the above-described second embodiment.

FIGS. 5*a*, 5*b* and 5*c* show a partition unit in accordance with the fourth embodiment of this invention which comprises a combination of the first and second embodiments. Arranged in the partition unit at positions on the left-hand (or right-hand) side (as seen in the drawing) of the cooling plate 2 are a vertical crossflow fan 4*h* for blowing out breeze, an air inlet 4*ha* extending in the vertical direction, and a breeze outlet 4*hb* whose duct angle can be adjusted. At the same time, a baffle plate 9 is provided in the air passage 7 through which flows the air 30 for absorbing heat from the radiation fins 2*b* of thermoelectric elements 2*a*. This baffle plate 9 divides the air passage 7 into a heat-dissipating-air passage 71 and a breeze air passage 72. Further, a breeze outlet 4*b*2 communicating with the breeze air passage 72 is arranged immediately below the cooling plate 2.

Figure 6:
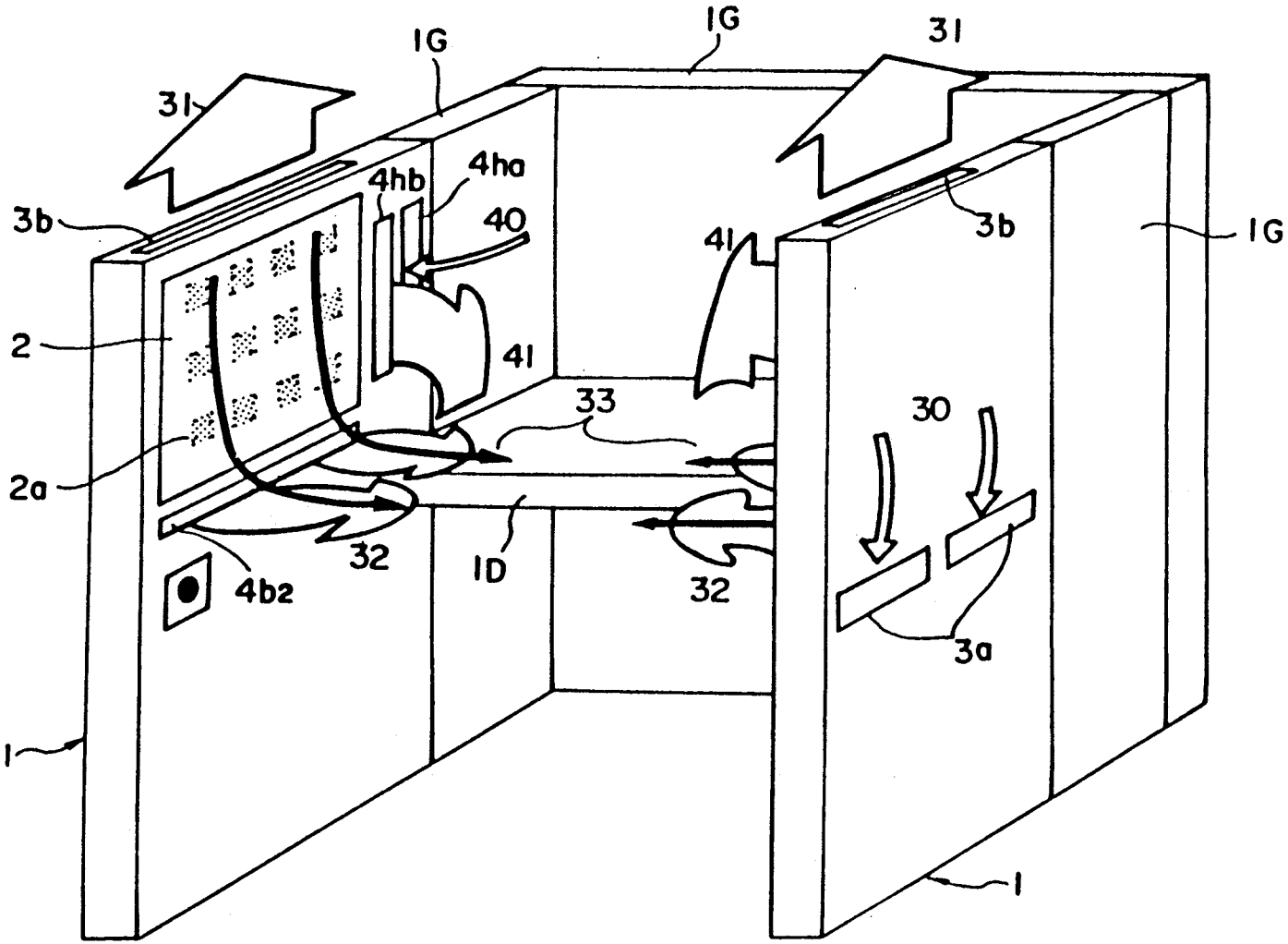
FIG. 6 is an overall perspective view of a partition-type radiation local air conditioning unit in accordance with the fourth embodiment.

FIG. 6 is an overall perspective view of a partition type radiation local air conditioning unit which consists of a partition assembly including partition units in accordance with the fourth embodiment of this invention. This radiation type air conditioner is composed of a pair of partition units 1,1 and an ordinary partition 1G arranged between them, the whole exhibiting, in plan, a U-shaped configuration. In one blowing out breeze, an air inlet 4*ha*, and a breeze outlet 4*hb* are arranged on the right-hand side of the cooling plate 2; in the other partition unit 1, these components are arranged on the left-hand side of the cooling plate 2. Arranged in the middle stage of the ordinary partition 1G is a worktable 1D, on which an OA equipment unit or the like may be set, thus providing a so-called workstation. The operator sitting in front of the worktable 1D receives breeze 41 coming obliquely from the breeze outlets 4*hb*, the breeze being blown against the face of the operator, making him or her feel coolness. The breeze 32 coming from the breeze outlets 4*b*2 provided below the cooling plates 2 is blown, together with the cold air descending along the cooling plates 2, against the upper half of the body of the operator, which also makes him or her feel coolness. In addition, the radiation cooling by the cooling plates 2 makes itself directly felt by the operator. All, these cooling effects work as a synergetic effect, thereby further enhancing the coolness.

Thus, in the partition type radiation local air conditioning unit of this invention, breeze and convection are effectively combined with radiation cooling, thereby making it possible to provide a better feeling of coolness and to diminish the apparatus size.

The present invention should not be construed as restricted to the embodiments shown and described above; various modifications may be made without departing from the spirit or scope of the following claims.

What is claimed is:

1. A partition type radiation local air conditioning unit comprising: a partition unit; a cooling plate provided in said partition unit; a plurality of thermoelectric elements provided in said cooling plate and adapted to produce the Peltier effect, radiation air cooling being effected by cooling said cooling plate by the Peltier effect obtained by said thermoelectric elements; a plurality of radiation fins associated with said thermoelectric elements; a crossflow fan for heat-dissipating-air blowing provided in said partition unit and adapted to suck in air from the exterior, the air thus sucked in absorbing heat from said radiation fins and being blown out to the exterior as heat-dissipating air; an air passage provided between said cross-flow fan for heat-dissipating-air blowing and said radiation fins; a baffle plate provided in said air passage and dividing said air passage into a heat-dissipating-air passage and a breeze passage; and a breeze outlet provided immediately below said cooling plate and communicating with said breeze passage.

2. A partition type radiation local air conditioning unit comprising:

a partition unit having first and second vertical sides;

a cooling plate positioned in said first vertical side of said partition unit and having first and second vertical side edges, upper and lower horizontal edges, and an outer surface and an inner surface;

a plurality of thermoelectric elements associated with said cooling plate and adapted to cause said cooling plate to absorb heat;

a first air inlet in said partition unit, wherein said first air inlet extends vertically in said first vertical side of said partition;

a breeze outlet in said first vertical side of said partition unit, said breeze outlet being located between said first air inlet and said cooling plate and extending vertically adjacent to one of said vertical side edges of said cooling plate;

a first fan positioned in said partition unit to suck in air through said first air inlet and to blow out air through said breeze outlet, past said one of the edges of said cooling plate, and across said outer surface of said cooling plate;

a plurality of radiation fins associated with said thermoelectric elements;

a second air inlet in said second vertical side of said partition unit;

an air outlet in an upper portion of said partition unit; and a second fan positioned in said partition unit to suck in air through said second air inlet and to blow air across said radiation fins and out through said air outlet.

3. A partition type radiation local air condition unit comprising:

a partition unit having first and second vertical sides;

a cooling plate positioned in said first vertical side of said partition unit and having first and second vertical side edges, upper and lower horizontal edges, and an outer surface and an inner surface;

a plurality of thermoelectric elements associated with said cooling plate and adapted to cause said cooling plate to absorb heat;

an air inlet in said partition unit;

a breeze outlet in said first vertical side of said partition unit adjacent to one of the edges of said cooling plate; wherein said breeze outlet extends horizontally below and adjacent to said lower horizontal edge of said cooling plate;

a fan positioned in said partition unit to suck in air through said air inlet and to blow out air through said breeze outlet, past said one of the edges of said cooling plate, and across said outer surface of said cooling plate; wherein said fan has an outlet with elements defining a first air passageway connected between said outlet of said fan and said breeze outlet;

a plurality of radiation fins associated with said thermoelectric elements;

an air outlet in an upper portion of said partition unit; and elements defining a second air passageway from said outlet of said fan across said radiation fins and through said air outlet.

4. A partition type radiation local air conditioning unit in accordance with claim 3 wherein said first air inlet is located in said second vertical side of said partition unit.

5. A partition type radiation local air conditioning unit in accordance with claim 4 wherein the horizontal length of said breeze outlet is approximately the horizontal width of said cooling plate.

6. A partition type radiation local air conditioning unit in accordance with claim 4 wherein the horizontal length of said breeze outlet is at least half of the horizontal width of said cooling plate.

7. A workstation having at least two vertical side partition units and a vertical front partition unit associated together to form an operator work environment inside said workstation, at least one of said side and front partition units being a partition type radiation local air conditioning unit comprising:

a partition unit having first and second vertical sides;

a cooling plate positioned in said first vertical side of said partition unit and having first and second vertical side edges, upper and lower horizontal edges, and an outer surface and an inner surface;

a plurality of thermoelectric elements associated with said cooling plate and adapted to cause said cooling plate to absorb heat;

an air inlet in said partition unit;

a breeze outlet in said first vertical side of said partition unit adjacent to one of the edges of said cooling plate; and a fan positioned in said partition unit to suck in air through said inlet and to blow out air through said breeze outlet, past said one of the edges of said cooling plate, and across said outer surface of said cooling plate;

and said workstation further comprising means for supplying said thermoelectric elements with electric current in a first direction to cool said plate and thereby effect cooling of the operator work environment within said workstation.

8. A workstation having at least two vertical side partition units and a vertical front partition unit associated together to form an operator work environment inside said workstation, at least one of said side and front partition units being a partition type radiation local air conditioning unit in accordance with claim 2, and means for supplying said thermoelectric elements with electric current in a first direction to cool said plate and thereby effect cooling of the operator work environment within said workstation.

9. A workstation having at least two vertical side partition units and a vertical front partition unit associated together to form an operator work environment inside said workstation, at least one of said side and front partition units being a partition type radiation local air conditioning unit in accordance with claim 4, and means for supplying said thermoelectric elements with electric current in a first direction to cool said plate and thereby effect cooling of the operator work environment within said workstation.

10. A partition type radiation local air condition unit comprising: a partition unit; a cooling plate provided in said partition unit; a plurality of thermoelectric elements provided in said cooling plate and adapted to produce the Peltier effect, radiation air cooling being effected by cooling said cooling plate by the Peltier effect obtained by said thermoelectric elements; a breeze generating means provided in said partition unit and including a crossflow fan for blowing out breeze, an air inlet, and a breeze outlet; said breeze generating means being so arranged that the breeze from said breeze outlet is substantially blown against the face of a person sitting in front of said partition unit; a plurality of radiation fins associated with said thermoelectric elements; a second crossflow fan for heat-dissipating-air blowing provided in said partition unit and adapted to suck in air from the exterior, the air thus sucked in absorbing heat from said radiation fins and being blown out to the exterior as heat-dissipating air; an air passage provided between said second crossflow fan and said radiation fins; a baffle plate provided in said air passage and dividing said air passage into a heat-dissipating-air passage and a breeze passage; and a second breeze outlet provided below said cooling plate and in communication with said breeze passage.

* * * * *

UNITED STATES PATENT AND TRADEMARK OFFICE

CERTIFICATE OF CORRECTION

PATENT NO. : 5,074,116

DATED : December 24, 1991

INVENTOR(S) : Kanichi Kadotani, ET AL

It is certified that error appears in the above-identified patent and that said Letters Patent is hereby corrected as shown below:

Column 1, line 33, change "IF" to --1F--;
line 37, change "IF" to --1F--;
line 53, change "IF" to --1F--;
line 57, following "contact" please insert --with the radiation fins 2b, absorbing the heat which is--;
line 62, change "IF" to --1F--.

Column 4, line 63, following "one" please insert --partition unit 1, a vertical cross-flow fan 4h for--.

Column 6, line 11, change "condition" to --conditioning--.

Column 7, line 5, following the first occurrence of "said" please insert --air --.

Column 8, line 4, change "condition" to --conditioning--.

Signed and Sealed this

Fourth Day of January, 1994

Attest:

Attesting Officer

BRUCE LEHMAN

Commissioner of Patents and Trademarks